US008167780B2

(12) United States Patent
Allen

(10) Patent No.: US 8,167,780 B2
(45) Date of Patent: May 1, 2012

(54) PHYSICAL TRAINING DEVICE AND METHOD

(76) Inventor: Ralph C. Allen, Elko, NV (US)

( * ) Notice: Subject to any disclaimer, the term of this patent is extended or adjusted under 35 U.S.C. 154(b) by 52 days.

(21) Appl. No.: 12/721,239

(22) Filed: Mar. 10, 2010

(65) Prior Publication Data

US 2011/0224056 A1 Sep. 15, 2011

(51) Int. Cl.
*A63B 21/02* (2006.01)
*A63B 21/045* (2006.01)

(52) U.S. Cl. ..... 482/126; 482/127

(58) Field of Classification Search ..... 482/127–128, 482/121–122, 44–50, 126
See application file for complete search history.

(56) References Cited

U.S. PATENT DOCUMENTS 4,483,533 A * 11/1984 Mangiapane ..... 482/122
4,973,043 A * 11/1990 Nolan ..... 482/45
D322,827 S 12/1991 Bennstrom et al.
D338,247 S 8/1993 Koblick
D341,401 S 11/1993 Reichman
5,308,299 A * 5/1994 Winston ..... 482/49
5,399,138 A * 3/1995 Jones ..... 482/127
5,507,712 A * 4/1996 Chang ..... 482/126
5,626,545 A * 5/1997 Newman et al. ..... 482/127
6,071,214 A * 6/2000 Osterman ..... 482/44
6,561,959 B2 5/2003 Batiste
6,743,159 B1 * 6/2004 Taylor et al. ..... 482/127
7,008,354 B2 3/2006 Wen
2009/0042701 A1 2/2009 Tsai
2009/0239722 A1 9/2009 Bisson

* cited by examiner

*Primary Examiner* — Fenn Mathew
(74) *Attorney, Agent, or Firm* — Oliff & Berridge, PLC

(57) ABSTRACT

A physical training device includes two arm portions connected to each other and movable toward and away from each other. Two grip portions are provided at the respective arm portions. The grip portions together have the shape of a ball, such as a basketball or football. A resilient device urges the grip portions away from each other toward an extended position. The physical training device is particularly useful in training for basketball rebounding.

18 Claims, 5 Drawing Sheets

PHYSICAL TRAINING DEVICE AND METHOD

BACKGROUND

This disclosure relates to a physical training device and method that enhances muscle strength and/or technique involved in grasping an object overhead, such as when rebounding a basketball or catching a football.

Some sports, such as basketball and football, and other activities, often involving grabbing a ball overhead. Strength and technique training can enhance an individual's performance in these actions. A basketball rebounding training device is known that holds a basketball overhead on a spring-loaded arm, with which a user trains by jumping up, grabbing the ball and pulling the ball downward against the resistance of the spring-loaded arm.

SUMMARY

Disadvantages of the training device described above include cost and bulkiness. It would be advantageous to have a training device that is much less bulky and much more compact.

Various scissor-type exercise devices are known, such as those disclosed in U.S. Pat. No. 6,561,959, U.S. Pat. No. 7,008,354, U.S. Design Pat. No. D322,827, U.S. Design Pat. No. D338,247, U.S. Design Pat. No. D341,401, U.S. Published Patent Application No. 2009/0042701, and U.S. Published Patent Application No. 2009/0239722. These devices have the advantage of being compact. However, they are not disclosed for use in enhancing muscle strength and/or technique involved in grasping an object overhead, such as when rebounding a basketball or catching a football. Furthermore, they do not have structures that facilitate strengthening of fingers and/or hand muscles involved in catching or gripping a ball.

Embodiments of a physical training device disclosed herein are similar in some respects to the devices disclosed in the above-mentioned references, but include grip portions that facilitate strengthening of fingers and/or hand muscles involved in catching or gripping a ball. For example, the grip portions may together substantially have a shape of a ball.

BRIEF DESCRIPTION OF THE DRAWINGS

Embodiments will be described below with reference to the attached drawings, in which like numerals represent like parts and in which.

DETAILED DESCRIPTION OF EMBODIMENTS

Figure 1:
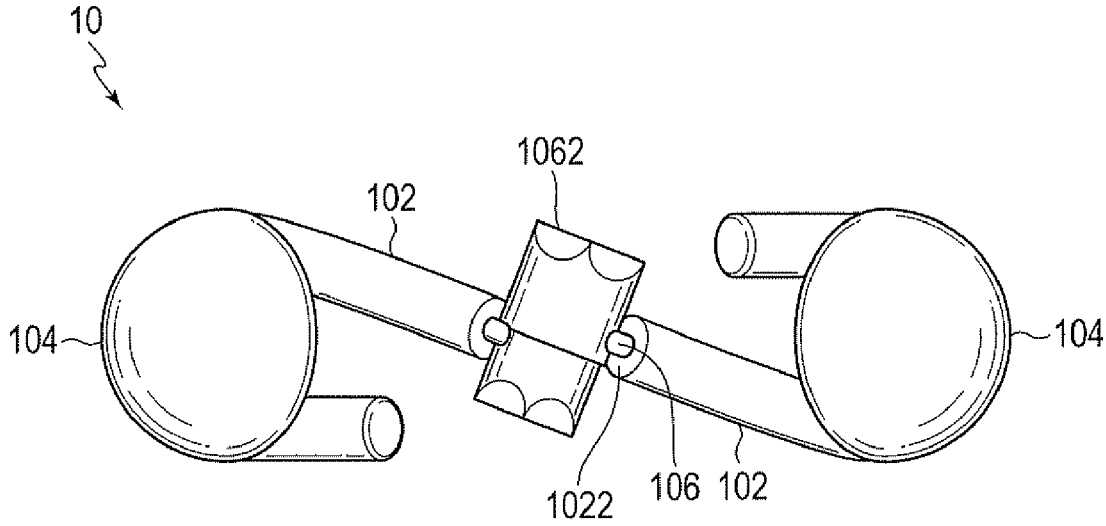
FIG. 1 is a top view of a first embodiment of a physical training device.
Figure 2:
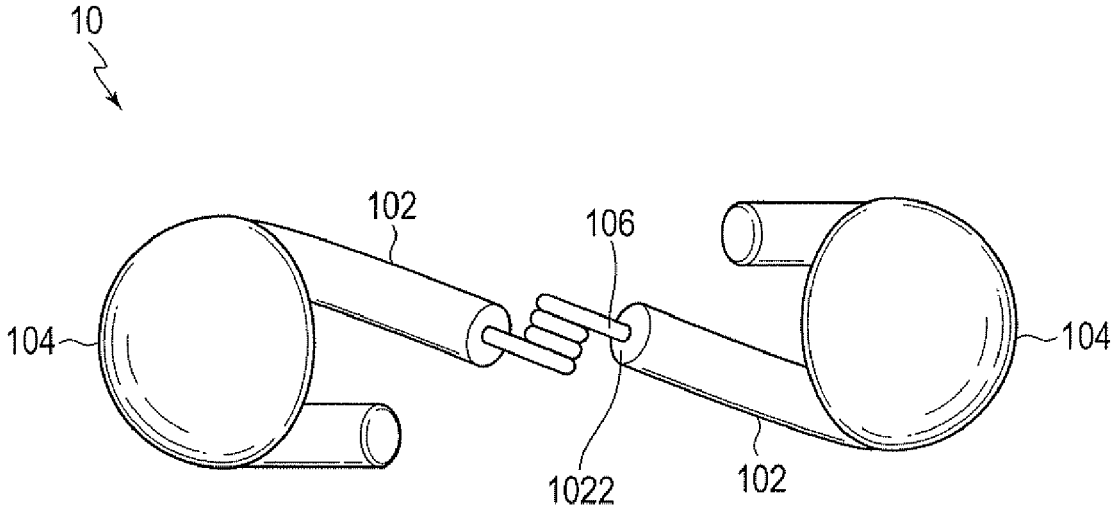
FIG. 2 is top view of the physical training device of FIG. 1, with a resilient device exposed.
Figure 3:
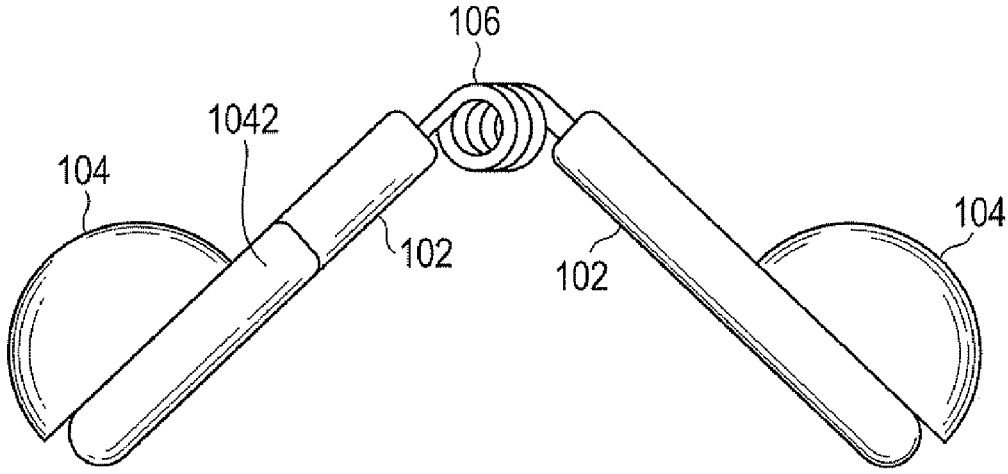
FIG. 3 is front view of the physical training device of FIG. 1, with a resilient device exposed.

FIG. 1 is a top view of a first embodiment of a physical training device 10, which comprises two arm portions 102, two grip portions 104, and a resilient device 106. The resilient device 106 in this example is covered by a housing 1062. FIGS. 2 and 3 show a top view and front view, respectively, of the physical training device of FIG. 1, with the housing removed so that the resilient device 106 resilient device is exposed. The resilient device 106 in this example is a coil spring.

Figure 4:
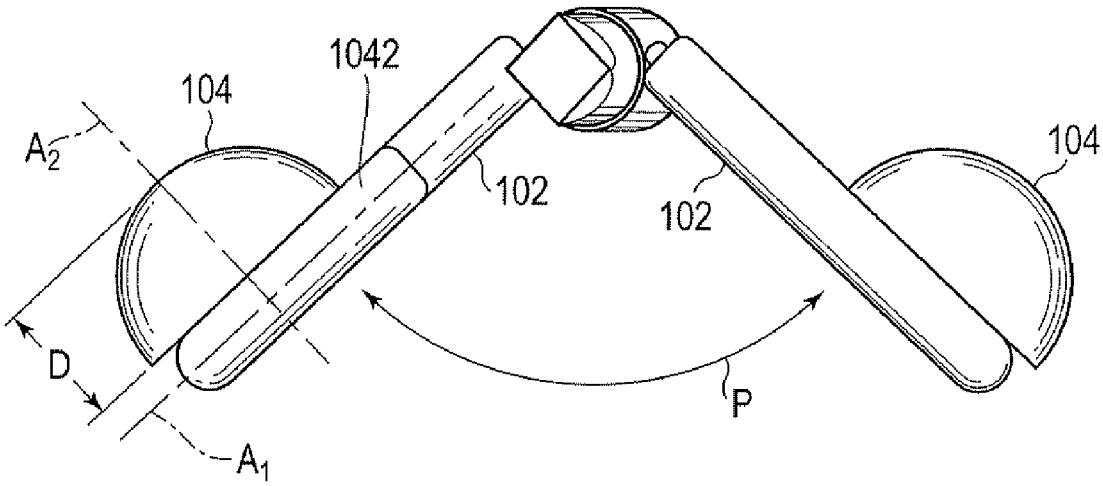
FIG. 4 is a front view of the physical training device of FIG. 1.

FIG. 4 is a front view of the physical training device 10. As shown in FIGS. 1 and 4, ends of the arm portions 102 are connected to each other, in this example via the resilient device 106. The arm portions 102 are formed as one piece with the arm portions 102. In other embodiments, ends of the arm portions 102 may be connected to each other via a connection member such as a pin or hinge, and a separate resilient device may be provided such as a coil spring or a compression spring. As another example, an adjustable tension unit may be provided as the resilient device. An example of an adjustable tension unit is disclosed in U.S. Pat. No. 6,561,959.

The arm portions 102 in this example each have substantially a J shape. Padding 1022 covers the arm portions 102. Other embodiments may have arm portions with different shapes, and/or having no padding. The J shape of the arm portions 102 in this embodiment provides a stable mounting surface for attaching the grip portions 104. In other embodiments, rather than a scissors-type structure as depicted in FIG. 1, arm portions may be provided that are connected to each other by being slidable with respect to each other, such as by being formed as tubes, one sliding inside the other. In this case, the resilient device may be a compression spring that is accommodated inside the telescoping tubes.

The grip portions 104 in this embodiment are substantially hemispherical, and thus together have the shape of a substantially spherical bail. The grip portions 104 may comprise an elastically deformable surface. For example, the grip portions 104 may comprise a spongy material from which NERF™ balls are made, and thus have an elastically deformable surface. As another example, a relatively hard grip portion may be covered with foamed rubber or other spongy material, and thus have an elastically deformable surface. In other embodiments, the grip portions 104 may have relatively hard surfaces. An elastically deformable surface may be more comfortable to grip, and may better hold the fingertips in place so that they do not slip. A relatively hard surface may provide a feel that better approximates that of an actual basketball or football, for example.

The grip portions 104 may be attached to the arm portions 102 in any suitable manner. For example, they may be attached by adhesive positioned at the interface 1042 between the arm portions 102 and the grip portions 104. One suitable adhesive for this purpose is "GOOP" brand "All Purpose Contact Adhesive and Sealant."

When pressed toward each other, the two grip portions 104 follow a movement path P that is, in this embodiment, an arcuate path. In other embodiments, such as the "sliding tube" embodiment described above, the movement path may be linear. The resilient device 106 resists this movement, and urges the grip portions 104 away from each other toward an extended position such as is shown in FIG. 4. In the extended position, the distance between free ends of the arm portions 102 may be in a range of from about 12 inches to 24 inches.

The force to move the grip portions 104 to a fully closed position, i.e., a position at which the free ends of the arm portions 102 are touching, may be set by the manufacturer, but may in some embodiments be in a range of from about 5 pounds to about 50 pounds or any smaller range encompassed therein, such as from about 10 pounds to about 40 pounds, or from about 20 pounds to 30 pounds. In a specific example of an embodiment using a coil spring as the resilient device 106 as described above, the force may be variable. For example, to move the grip portions toward each other from a position at which the free ends of the arm portions 102 are about 16 inches apart to a position at which the free ends of the arm portions 102 are about 12 inches apart, a force of about 8 pounds may be required; to move the grip portions further until the free ends are about 9 inches apart, a force of about 13 pounds may be required; to move the grip portions further until the free ends are about 3 inches a part, a force of about 17 pounds may be required; and to move the grip portions further until the free ends are touching, a force of about 20 pounds may be required.

Figure 5:
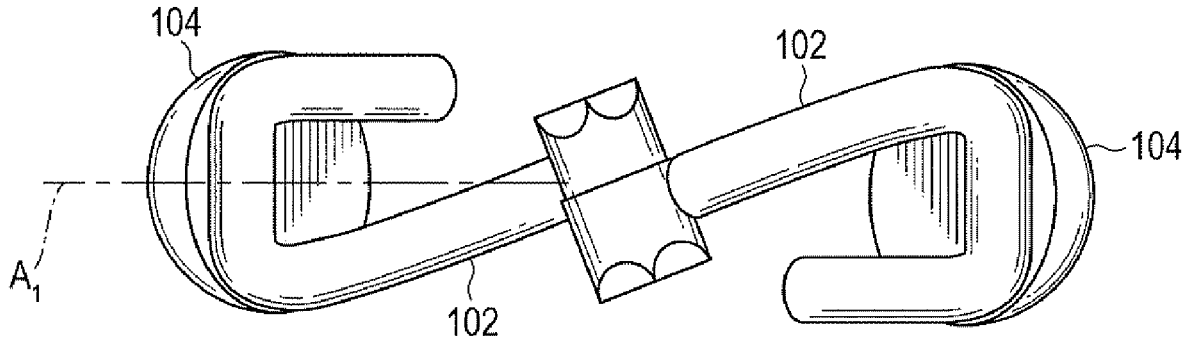
FIG. 5 is a bottom view of the physical training device of FIG. 1.
Figure 6:
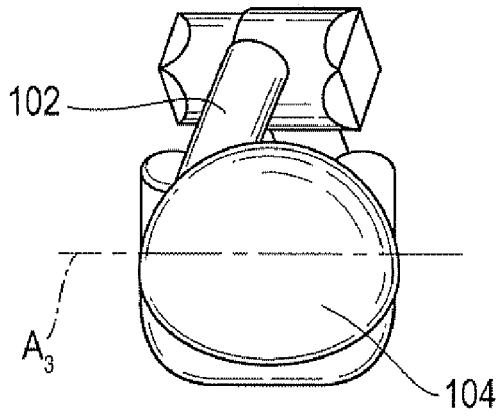
FIG. 6 is a right-side view of the physical training device of FIG. 1 (which is identical to a left-side view (not shown))

In this embodiment, the grip portions 104 each have a dimension, along an axis $A_3$ perpendicular to the movement path and perpendicular to an axis $A_1$ of the respective arm portion, of at least 4 inches. (See FIGS. 4-6.) The dimension may be in a range of from 4 inches to about 18 inches, or any smaller range encompassed therein, such as from about 6 inches to about 16 inches or from about 8 inches to about 12 inches. Each grip portion 104 may have a dimension D of at least 2 inches in a direction of a center axis $A_2$ parallel to the movement path (see FIG. 4). The dimension D may be in a range of from 2 inches to about 12 inches, or any smaller range encompassed therein, such as from about 4 inches to about 10 inches or from about 6 inches to about 8 inches.

Figure 7:
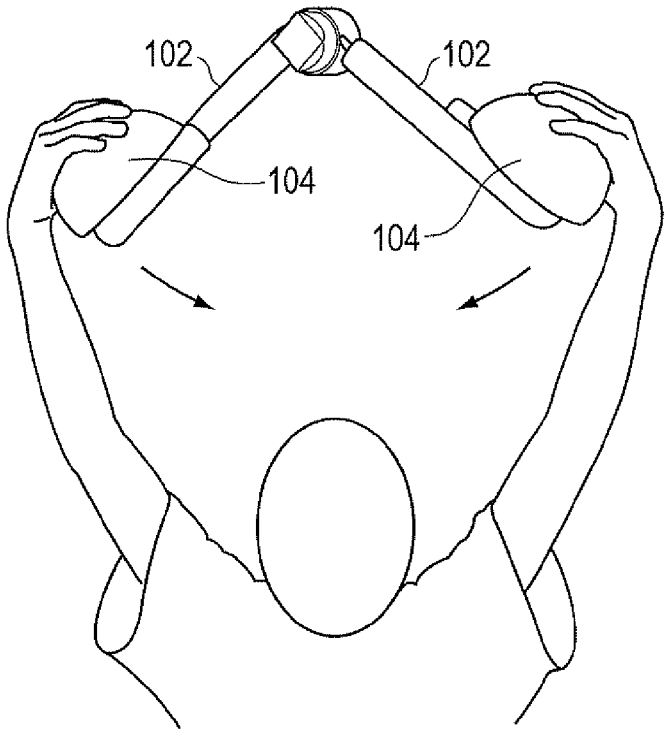
FIG. 7 illustrates a user holding the physical training device of FIG. 1 in an extended position.
Figure 8:
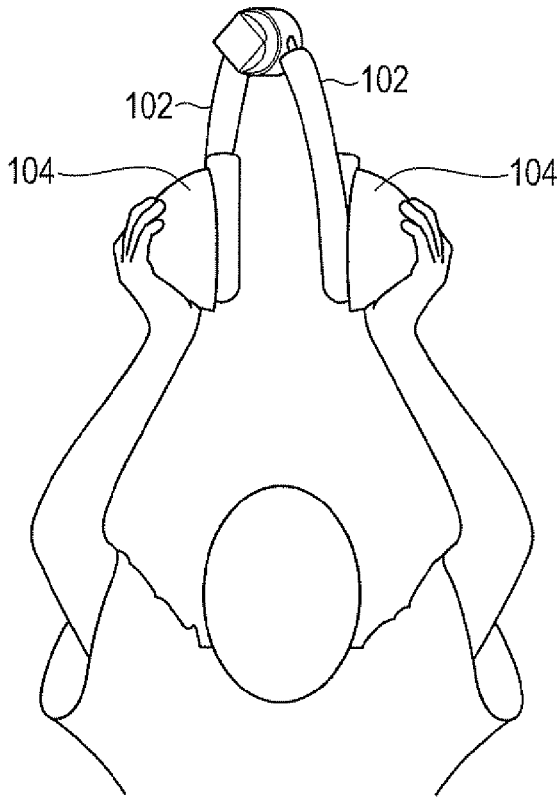
FIG. 8 illustrates a user holding the physical training device of FIG. 1 in a compressed position.

FIGS. 7-8 depict a training method in which a training device as described above is used. As shown in FIG. 7, a user holds the device 10 overhead, with the arm portions 102 in the extended position. The user then applies force to the grip portions 104 to urge the grip portions 104 inward toward each other, as shown in FIG. 8. This motion may be repeated as desired.

As shown in FIGS. 7-8, the grip portions 104 are shaped and sized to be contacted by the fingertips of the user's extended fingers. The user's palms may also contact the grip portions 104.

When the training device 10 is used as shown in FIGS. 7-8, it tends to twist about a vertical axis above the user's head. This forces the muscles to resist the twisting action, in addition to applying inward force to urge the grip portions together. The result can be well toned muscles uniquely trained for the action of, e.g., rebounding a basketball.

Figure 9:
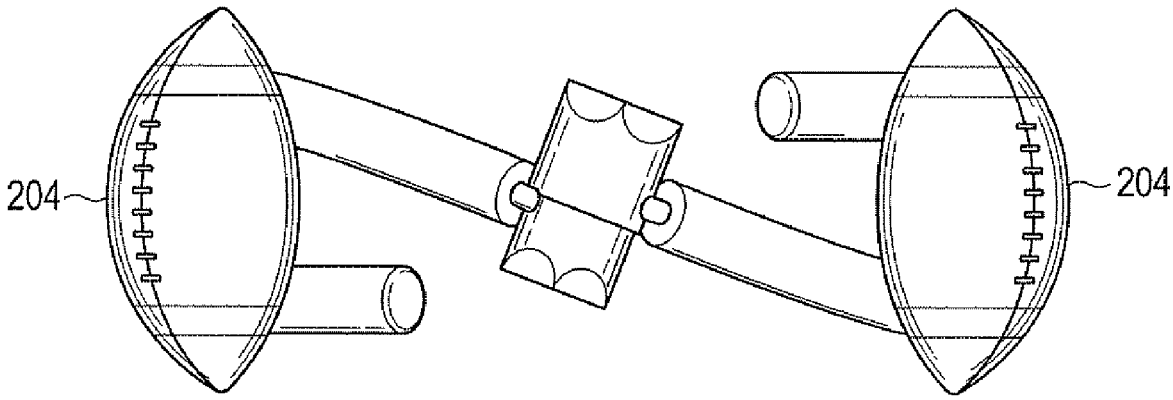
FIG. 9 is a top view of a second embodiment of a physical training device.

FIG. 9 is a top view of a second embodiment of a physical training device. This embodiment is the same as that described above, except that it has grip portions 204 that together form a football shape.

The embodiments described above are relatively compact in size, and can be manufactured and sold at a relatively low cost. In the context of training for team sports such as basketball and football, rather than purchasing a single conventional device at high cost, a team or organization may more easily purchase and store multiple devices according to an embodiment described above, so that multiple players may train simultaneously.

While the invention has been described in conjunction with specific embodiments, these embodiments should be viewed as illustrative and not limiting. Various changes, substitutes, improvements or the like are possible within the spirit and scope of the invention.

For example, while ball-shaped grip portions have been depicted, other embodiments may have grip portions that are not ball-shaped, but which nonetheless have a shape that facilitates strengthening of fingers and/or hand muscles involved in catching or gripping a ball. For example, a cube shape or other three-dimensional regular or irregular shape may be used in some embodiments.

What is claimed is:

1. A physical training device, comprising:

two arm portions connected to each other, free ends of the arm portions being movable toward and away from each other;

two grip portions, each grip portion having a base surface attached to a respective one of the arm portions, each grip portion following an arcuate movement path when the arm portions move toward and away from each other, the grip portions together substantially having a shape of a single ball if placed adjacent to each other; and a resilient device that urges the grip portions away from each other toward an extended position.

2. The physical training device of claim 1, wherein the grip portions are shaped and sized to contact fingertips and force the fingertips to be in an outstretched state when the grip portions are gripped by the fingertips, while not permitting the fingertips to contact the base surface of the grip portion.

3. The physical training device of claim 2, wherein the grip portions each have a dimension, along an axis perpendicular to the movement path and perpendicular to an axis of the respective arm portion, of at least 4 inches.

4. The physical training device of claim 1, wherein the grip portions comprise an elastically deformable surface.

5. The physical training device of claim 1, wherein the shape of the ball is a basketball shape.

6. The physical training device of claim 1, wherein the shape of the ball is a football shape.

7. The physical training device of claim 1, wherein a force of at least 12 pounds is required to move the grip portions to a fully closed position.

8. The physical training device of claim 1, wherein each arm portion comprises two spaced-apart portions that both contact a base of one of the grip portions and provide a stable mounting surface for the one of the grip portions.

9. A training method, comprising:

holding the physical training device of claim 1 overhead, with one hand on each grip portion; and exerting force on the grip portions, with the hands, to urge the grip portions toward each other.

10. A physical training device, comprising:

two arm portions connected to each other, free ends of the arm portions being movable toward and away from each other;

two grip portions, each grip portion having a base surface attached to a respective one of the arm portions, an arcuate movement path a movement path when the arm portions move toward and away from each other, each grip portion having a center axis parallel to the movement path and having a dimension of at least 2 inches in a direction of the center axis, an outer surface of each grip portion being sized and shaped to contact fingertips and force the fingertips to be in an outstretched state when the grip portions are gripped by the fingertips, the size and shape not permitting the fingertips to contact the base surface of the grip portion; and a resilient device that urges the grip portions away from each other toward an extended position.

11. The physical training device of claim 10, wherein the grip portions each have a dimension, along an axis perpendicular to the movement path, of at least 4 inches.

12. The physical training device of claim 10, wherein the grip portions comprise an elastically deformable surface.

13. The physical training device of claim 10, wherein the grip portions together substantially have a shape of a single ball if placed adjacent to each other, and the shape of the ball is a basketball shape.

14. The physical training device of claim 10, wherein the grip portions together substantially have a shape of a single ball if placed adjacent to each other, and the shape of the ball is a football shape.

15. The physical training device of claim 10, wherein a force of at least 12 pounds is required to move the grip portions to a fully closed position.

16. The physical training device of claim 10, wherein the grip portions each have a dimension, along an axis perpendicular to the movement path, of from about 4 inches to about 8 inches.

17. The physical training device of claim 10, wherein each arm portion comprises two spaced-apart portions that both contact a base of one of the grip portions and provide a stable mounting surface for the one of the grip portions.

18. A training method, comprising:

holding the physical training device of claim 10 overhead, with one hand on each grip portion; and exerting force on the grip portions, with the hands, to urge the grip portions toward each other.

* * * * *

UNITED STATES PATENT AND TRADEMARK OFFICE

CERTIFICATE OF CORRECTION

PATENT NO. : 8,167,780 B2
APPLICATION NO. : 12/721239
DATED : May 1, 2012
INVENTOR(S) : C. Ralph Allen It is certified that error appears in the above-identified patent and that said Letters Patent is hereby corrected as shown below:

Title page, item (76) Inventor: Ralph C. Allen, Elko, NV (US) should read as follows:

Item (76) Inventor: C. Ralph Allen, Elko, NV (US)

Signed and Sealed this
Twenty-fifth Day of September, 2012

David J. Kappos

David J. Kappos
*Director of the United States Patent and Trademark Office*